United States Patent [19]

Grigoriev et al.

Best Available Copy

[11] 4,247,736

[45] Jan. 27, 1981

[54] INDUCTION HEATER HAVING A CRYORESISTIVE INDUCTION COIL

[76] Inventors: Valentin A. Grigoriev, Malaya Filevskaya ulitsa, 64, kv. 19; Viktor M. Brodyansky, Novo-Cheremushkinskaya ulitsa, 52, korpus 2, kv. 31; Mikhail M. Sokolov, 9 Vatutinsky pereulok, 8; Alexandr B. Kuvaldin, Beskudnikovsky bulvar, 30, korpus 1, kv. 27, all of Moscow, U.S.S.R.

[21] Appl. No.: 972,063

[22] Filed: Dec. 21, 1978

[30] Foreign Application Priority Data

Dec. 26, 1977 [SU] U.S.S.R. ..... 2555076

[51] Int. Cl.[3] ..... H05B 6/24; H05B 6/42

[52] U.S. Cl. ..... 13/27; 13/32; 219/10.49 R; 219/10.79

[58] Field of Search ..... 219/10.49 R, 10.79, 219/10.51, 10.43; 13/27, 32, 26

[56] References Cited

U.S. PATENT DOCUMENTS

| | | | |
|---|---|---|---|
| 1,981,632 | 11/1934 | Northrup | 219/10.51 |
| 2,281,335 | 4/1942 | Somes | 219/10.51 |
| 3,461,215 | 8/1969 | Reboux | 219/10.51 |
| 3,551,115 | 12/1970 | Jamieson et al. | 219/10.49 X |
| 3,636,293 | 1/1972 | Schneider et al. | 219/10.49 |

FOREIGN PATENT DOCUMENTS

| | | | |
|---|---|---|---|
| 193631 | 5/1967 | U.S.S.R. | 13/27 |

OTHER PUBLICATIONS

"Handbook of Chemistry and Physics", 41st Ed., 1959–1960, pp. 2588–2591, Table of Metal Resistivity.

*Primary Examiner*—Roy N. Envall, Jr.
*Assistant Examiner*—Philip H. Leung
*Attorney, Agent, or Firm*—Lackenbach, Lilling & Siegel

[57] ABSTRACT

An induction heater having a cryoresistive induction coil comprising an induction coil positioned in a cryostat filled with a cryogenic coolant having a temperature in the range of from 15° to 120° K., a heat-insulating element disposed around the charge to be heated, and a cooled baffle interposed between the cryostat and the heat-insulating element, the induction coil being formed of a metal with chemical purity of 99.99 percent, and at least a part of the cryostat being made of a dielectric material.

4 Claims, 2 Drawing Figures

INDUCTION HEATER HAVING A CRYORESISTIVE INDUCTION COIL

BACKGROUND OF THE INVENTION

1. Field of the Application

The present invention relates to electrothermics and in particular to assemblies for induction heating generally known as induction heaters.

The invention is intended for use in induction melting and heating installations.

2. Description of the Prior Art

There is known a wide variety of induction heaters (cf. "Induction Melting Furnaces", by A. M. Vineberg, Moscoe Publishers, 1967, pp. 310–315, /in Russian/, which basically comprise an induction coil, a system for its cooling, and heat insulation. To achieve maximum efficiency in the use of power, the induction coil is formed of metals having low specific resistance, such as aluminum and copper; and to accomplish a maximum power per unit area, i.e. to increase the current of the induction coil, an air- or water cooling system is used. Heat insulation is utilized to reduce heat losses which occur at the surface of the heated metal.

The prior-art devices of the type described above, when operated at frequencies of 50 to 60 Hz, have the following power characteristics: power efficiency is 60 to 80 percent, power per unit area being not more than 1000 kW/m$^2$. In conventional induction heating and melting furnaces utilizing power capacity of 5 to 30 MW and above, the power losses in the induction coil are estimated at 1 to 10 MW, such value of the power per unit area being the reason for their insufficiently high production capacity.

There is also known an induction heater (cf. USSR Inventor's Certificate No. 193,631), which comprises an induction coil provided with a cooling system, a heat-insulating element in the form of a ceramic crucible, and a water-cooled metal baffle interposed therebetween.

However, the employment of the water-cooling system fails to accomplish power characteristics superior to those indicated above. It should be observed that the cooled baffle installed in the given device is used to facilitate the operation of the heat-insulating element under the prevailing heat conditions. With this purpose in view, a cooled baffle is positioned immediately adjacent to the heat-insulating element, which is the ceramic crucible in the given case.

SUMMARY OF THE INVENTION

It is an object of the present invention to enhance operating efficiency of an induction heater and to expand its production capabilities by way of reducing power losses in the inductor and by raising power per unit area in the charge being heated.

This object is accomplished in an induction heater comprising an induction coil provided with a cooling system, a heat-insulating element disposed around the charge being heated, and a cooled baffle interposed between the heat-insulating element and the induction coil. According to the invention, the cooling system includes a cryostat with pipes adapted to connect the latter with a source of creogenic coolant, the induction coil being placed within the cryostat and formed of a metal with a purity of its chemical composition being not less than 99.99 percent, the cryostat being filled with a cryogenic coolant having a temperature in the range of 15° to 120° K., at least a part of said cryostat being made of a dielectric material, forming an open electric circuit.

The induction coil in the device of the invention is preferably made of aluminum and a condensed gas with a temperature of 70° to 120° K. is preferably used as the cryogenic coolant.

It is feasible that the induction coil of the induction heater of the present invention be made of aluminum with the purity of its chemical composition being 99.995 percent, and the condensed gas used as the cryogenic coolant having a temperature of 15° to 35° K.

It is preferable that the cooled baffle provided in the induction heater of the invention be placed in close proximity with the cryostat and in spaced relationship with the heat-insulating element.

The invention makes it possible to achieve a substantial decrease in the specific resistance of the metal used for the induction coil owing to its higher chemical purity as well as due to its cooling to a temperature of 50° to 120° K., whereby power losses in the induction coil are reduced and the current is enhanced, thus making for an increase in the power per unit area.

BRIEF DESCRIPTION OF THE DRAWINGS

The invention will be further described, by way of example only, with reference to the accompanying drawings, wherein.

FIG. I is a longitudinal sectional view of an induction heater according to the invention.

DETAILED DESCRIPTION OF THE PREFERRED EMBODIMENT

Figure 1:
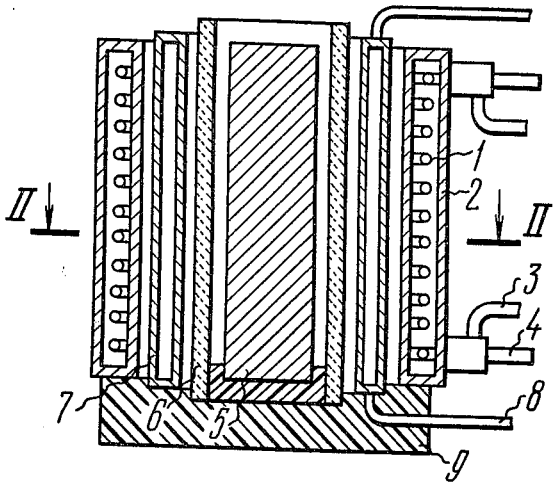

The induction heater illustrated, comprises an induction coil I rigidly fixed within a cryostat 2 connected through pipes 3 to a source of cryogenic coolant (not shown). There are provided in-leads 4 intended for connecting the induction coil I to a power source (not shown). Placed within the induction coil I is a charge 5 to be heated (usually a metal ingot). To reduce heat losses, the charge 5 is environed by a heat-insulating element 6, such as the ceramic crucible illustrated. The heat-insulating element 6 is used to protect the induction coil 1 from the effect of the heat passing off the charge 5.

Interposed between the cryostat 2 and the heat-insulating element 6 is a cooled metal baffle 7 intended for protecting the cryostat from excessive heating caused by the charge 5. There are provided inlet pipes 8 intended for the supply of coolant to the baffle 7. The cryostat 2, heat-insulating element 6 and cooled baffle 7 are arranged or located on a dielectric support structure 9.

Figure 2:
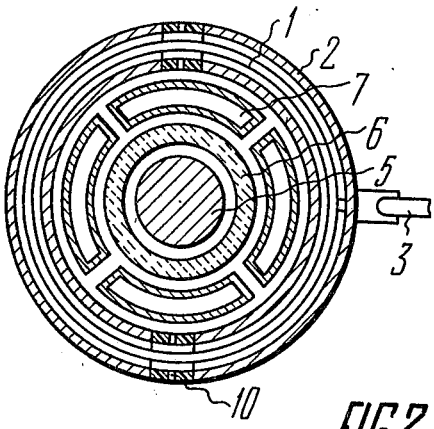
FIG. 2 is a cross-section taken along the line II—II of FIG. I, according to the invention.

Shown in FIG. 2 is a cross-section of the induction heater according to the invention. The cooled baffle 7 is made split, and at least a part of the cryostat 2 is formed of a dielectric material. Provided in the metal walls of the cryostat 2, as shown in FIG. 2, are dielectric inserts 10 which are arranged so as to form an open electric circuit. The induction coil I is formed of a metal with a purity of its chemical composition being not less than 99.99 percent, the temperature of the cryogenic coolant fed to the cryostat 2 being in the range of 15° to 120° K.

As alternating current passes through the induction coil I, magnetic field is produced in the latter to heat up the charge 5. Since the induction coil I is formed of a pure metal, which is cooled with a cryogenic coolant, the resistance of the induction coil I is substantially reduced to thereby result in lower power losses therein. With a flow of coolant circulating around the baffle 7, the cryostat 2 is protected from excessive heating produced by the charge 5.

To attain maximum effect, the cooled baffle 7 is arranged in close proximity with the cryostat 2 and in spaced relationship with the heat-insulating element 6. A flow of cryogenic coolant continuously fed along the connecting pipes 3 circulates within the cryostat 2, thereby maintaining a requisite temperature.

Alternatively, the induction coil I may be formed, for example, of aluminum, and a condensed gas with a temperature of 70° to 120° K. may be used as the cryogenic coolant. Specific resistance of aluminum is estimated at $2.5 \cdot 10^{-9}$ Ohm, that is 7 times less than that of copper at a temperature of 300° K.

In another embodiment, the induction coil I may be formed of aluminum with a purity of its chemical composition being not less than 99.995 percent, and the cryogenic coolant used is a condensed gas with a temperature of 15° to 35° K. Specific resistance of the aluminum is about $2 \cdot 10^{-11}$ Ohm, that is a thousand times less than that of copper at a temperature of 300° K.

The induction heater of the invention is advantageous in that it offers conservation of electric power and an enhanced operating efficiency of induction heaters at lower power losses and higher power per unit area due to Kelvin skin effect.

A reduction in power losses which takes place in the induction coil I is proportional not to specific resistance but to the square root of its value. However, there are known methods of the suppression of skin effect, for example, such that make use of small-diameter stranded-wire cables, allowing for power losses to be additionally reduced 100 times in the induction coil I made of aluminum with a purity of its chemical composition being 99.995 percent and when cooled to 20° K. and operating at a frequency of 50 Hz.

What is claimed is:

1. An induction heater comprising:

an induction coil for producing an electromagnetic field;

a means for cooling said induction coil, said means for cooling including a cryostat filled with a cryogenic coolant, and a plurality of pipes connecting said cryostat with a source of cryogenic coolant;

said induction coil disposed in said cryostat;

a heat-insulating element encompassing the product to be heated, said element having no provision for cooling and being made of a non-conductive material, whereby said heat-insulating suppresses the thermal flux released by said product to be heated toward said induction coil;

a cooled sectionalized baffle for suppressing the heat flux released by said product to be heated, said baffle being interposed between said cryostat and said heat-insulating element;

said induction coil being made of metal having at least 99.99 percent chemical purity;

said cryogenic coolant being of a temperature in the range from 15° to 120° K.; and said cryostat at least partially including a dielectric material thereby forming an open electric circuit.

2. An induction heater as claimed in claim 1, wherein the said induction coil is formed of aluminum, and said cryogenic coolant being a condensed gas with a temperature of 70° to 120° K.

3. An induction heater as claimed in claim 1, wherein said induction coil is formed of aluminum with a purity of its chemical composition of 99.995 percent, and a condensed gas with a temperature of 15° to 35° K. is used as the cryogenic coolant.

4. An induction heater as claimed in claims 1, 2, or 3, wherein said cooled baffle is placed in close proximity to said cryostat and in spaced relationship with said heat-insulating element.

* * * * *